United States Patent [19]

Cerutti et al.

[11] 4,302,507

[45] Nov. 24, 1981

[54] TWO-CONSTITUENT POLYAMIDE FILAMENT AND THE PROCESS FOR ITS PRODUCTION

[75] Inventors: Claude Cerutti, Saint Symphorien D'Ozon; Jean Goletto, Ecully; Robert Habault, Lyons; Yves Vaginay, Saint Priest, all of France

[73] Assignee: Rhone-Poulenc Textile, Paris, France

[21] Appl. No.: 132,418

[22] Filed: Mar. 21, 1980

Related U.S. Application Data

[63] Continuation of Ser. No. 958,556, Nov. 7, 1978, abandoned.

[30] Foreign Application Priority Data

Nov. 10, 1977 [FR] France ..... 77 34207

[51] Int. Cl.[3] ..... D02G 3/00

[52] U.S. Cl. ..... 428/373; 428/224; 428/370; 428/374

[58] Field of Search ..... 428/373, 374, 370, 224; 260/18 N; 528/324; 264/171

[56] References Cited

U.S. PATENT DOCUMENTS

| | | | |
|---|---|---|---|
| 3,418,199 | 12/1968 | Anton et al. | 428/374 |
| 3,574,047 | 6/1971 | Ando et al. | 428/374 |
| 3,709,865 | 1/1973 | Lofquist | 528/321 X |
| 3,901,989 | 8/1975 | Hokonoki et al. | 428/373 |

FOREIGN PATENT DOCUMENTS 1140479 1/1969 United Kingdom .

*Primary Examiner*—Lorraine T. Kendell

*Attorney, Agent, or Firm*—Stevens, Davis, Miller & Mosher

[57] ABSTRACT

The invention relates to a two-constituent textile filament.

It consists of a polyhexamethyleneadipamide and a copolyamide containing amide groups, which is produced from caprolactam and from at least one difunctional amide-forming reactant having a saturated long chain.

It can be used in the textile field and particularly in the knitted garment trade.

7 Claims, 4 Drawing Figures

TWO-CONSTITUENT POLYAMIDE FILAMENT AND THE PROCESS FOR ITS PRODUCTION

This is a continuation of application Ser. No. 958,556 filed Nov. 7, 1978 now abandoned.

The invention relates to two-constituent filaments which are made entirely of polyamide and lead to knitted fabrics possessing a very good elastic recovery.

In fact, it is known that knitted articles, such as stockings or panty hoses, are subjected to repeated pulling forces during the various movements of the leg, with the result that, if the crimped yarn from which they are made does not possess an adequate elastic recovery, the article becomes stretched and deformed when being worn and no longer fits the leg sufficiently well.

It is for this reason that these hosiery articles have hitherto generally been manufactured with a polyamide yarn texturised by the false twist technique, which leads to knitted fabrics possessing a satisfactory elastic recovery; however, this texturising technique is expensive.

It is known from French Pat. Nos. 1,331,188 and its Addition 89,390, 1,600,923 and 2,023,301, for example, to manufacture two-constituent yarns, one of which is a homopolyamide, such as polyhexamethyleneadipamide, and the other of which is a binary or ternary copolyamide. However, it is known that, although they possess a good crimp, yarns of this kind lead to knitted fabrics which either do not possess an adequate elastic recovery for the manufacture of articles of hosiery, or only possess this recovery after a high-temperature steam treatment.

It is also known from French Pat. No. 1,453,316 to manufacture two-constituent yarns of the "core-sheath" or side-by-side type, in which one of the constituents is a non-elastomeric polymer, such as polyamide or polyester, and the other is an elastomeric polymer, such as N-alkylated polyamide, the preparation of which is complicated, or polyester-urethane which is difficult to spin simultaneously with a polyamide or polyester because of the poor heat stability of the urethane bond.

Finally, British Pat. No. 1,455,186 describes multiple-component polyamide filaments, in which one of the components is a polyamide obtained from the usual constituents for the formation of polyamide, in the presence of 1 to 25% by weight of a di- and/or tri-carboxylic acid containing at least 30 carbon atoms, or of its di- and/or tri-amine salts. However, virtually all these yarns, and in particular those obtained in accordance with the examples of this patent, possess a crimp which is generally fairly good but they lead to knitted fabrics having a low elastic recovery which is inadequate for the hosiery article.

The present invention relates to a textile filament having two continuous constituents over the whole length of the filament, which is capable of leading to knitted fabrics of high elastic recovery, characterised in that one of the constituents is polyhexamethyleneadipamide and the other constituent is a copolyamide produced from caprolactam and at least one long-chain amide-forming difunctional reactant which is essentially saturated and pure and possesses a divalent aliphatic or cycloaliphatic hydrocarbon radical optionally possessing at least one hydrocarbon substituent and containing at least 20 carbon atoms, the said long-chain reactant being either a diacid or a diamine, in the form of their salts formed with one another or with another saturated diamine or diacid.

The invention also relates to a process for the production of the above filament by extruding the two above constituents simultaneously, in the molten state, through the same spinneret orifices, and then stretching the filament obtained.

The copolyamide used according to the present invention is preferably produced by the polycondensation of caprolactam with a salt of a diacid or diamine having a long hydrocarbon chain with another saturated aliphatic diamine or diacid, the hydrocarbon chain of which can be long or short. It is also possible to use a copolyamide produced from caprolactam and a salt of a diacid with a diamino, both of which are long-chain.

For the preparation of the copolyamide used according to the present invention, the caprolactam should represent 40 to 80% by weight, and preferably 50 to 70%, of the total reactants employed.

Dimeric fatty acids possessing at least 22 carbon atoms are generally used as the diacid having a long hydrocarbon chain. These acids result from the dimerisation of ethylenically unsaturated aliphatic monocarboxylic acids containing at least 11 carbon atoms, such as undecenoic, dodecenoic or linoleic acid or the like, or of their lower alkyl esters.

The preferred acids are olefinically mono- or polyunsaturated acids having 18 carbon atoms. Octadecenoic acids which may be mentioned are 4-octadecenoic, 5-octadecenoic, 6-octadecenoic (petroselinic), 7-octadecenoic, 8-octadecenoic, cis-9-octadecenoic (oleic), trans-9-octadecenoic (claidic), 11-octadecenoic (vaccenic) and 12-octadecenoic acids and the like. Octadecadienoic acids which may be mentioned are 9,12-octadecadienoic (linoleic), 9,11-octadecadienoic, 10,12-octadecadienoic and 12,15-octadecadienoic acids and the like. Examples of octadecatrienoic acids are 9,12,15-octadecatrienoic (linolenic), 6,9,12-octadecatrienoic, 9,11,13-octadecatrienoic and 10,12,14-octadecaterienoic acids and the like.

In practice, the dimeric acids are generally prepared by polymerising mixtures of acids or of their methyl esters derived from natural oils or from similar materials.

Linoleic acid, which is more readily available, or its mixtures with oleic acid or linolenic acid, are preferably used.

Ethylenically unsaturated acids can be polymerised by using known catalytic or non-catalytic polymerisation techniques. Under the action of heat by itself, monoolefinic acids (or their esters) are polymerised at a very slow rate, whereas polyclefinic acids (or their esters) are polymerised at a reasonable rate. If the double bonds in the polyolefinic acids are in conjugated positions, the polymerisation is then more rapid. Catalysts formed by clays are commonly used to accelerate the dimerisation of unsaturated acids. The temperatures used are generally lower if a catalyst is employed.

The polymerisation of the desired ethylenically unsaturated acids gives relatively complex products which usually contain a predominant proportion of dimerised acids and a samller amount of residual trimeric acids.

Such dimeric acids have a more or less complex structure such as, for example:

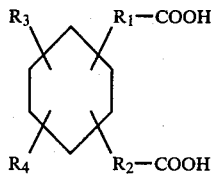

in which $R_1$ and $R_2$ are divalent hydrocarbon radicals and $R_3$ and $R_4$ are monovalent hydrocarbon radicals. Depending on the starting acid, the nucleus generally contains a double bond.

If these dimeric acids contain a further one or more double bonds, they are hydrogenated in order to give the corresponding saturated diacids.

Dimerised acids of high purity are obtained from the polymerisation products by means of distillation under reduced pressure, solvent extraction or other known separating processes.

So that it can be used in the present invention, the resulting diacid must be completely or almost completely saturated and as pure as possible.

In fact, if the long-chain reactant is inadequately purified, the copolyamide crystallises poorly and the resulting two-constituent filament does not crimp well. Likewise, if the long-chain reactant still possesses a few double bonds, the polycondensation medium solidifies.

A preferred long-chain diacid is a diacid which possesses 36 carbon atoms, contains less than 3% and preferably less than 1% of trimeric triacid, is virtually free from monoacid and is completely or almost completely saturated. Products of this type are commercially available under the trademark Empol, distributed by Unilever-Emery N.V., or Versadyme, produced by General Mills Chemicals, Inc.

The diamines having a long saturated hydrocarbon chain are prepared, for example, from the above dimeric diacids by the action of two mols of ammonia per mol of diacid to form the dinitriles, and hydrogenation of the dinitriles to give diamines. A dimeric diamine of this type is commercially available under the name Dimer Diamine 52 342, produced by General Mills Chemicals, Inc.

The long-chain diacids and diamines are salified with one another or with other saturated diamines or diacids having a short or long aliphatic chain, amongst which there may be mentioned, for example: for the diamines, hexamethylenediamine and dodecamethylenediamine, and for the diacids, adipic, suberic, azelaic, sebacic and dodecanedioc acids.

For the preparation of the copolyamide, it is possible, for example, to add the caprolactam to a solution of the preformed salt of diacid and diamine in a solvent mixture consisting of water and isopropanol or water and caprolactam. In the latter case, the caprolactam initially used as a constituent of the solvent for the salt than takes part in the polycondensation. It then suffices to adjust the amount of caprolactam in order to obtained the desired composition for the copolyamide. The polycondensation is carried out at about 270°–275° C.

The two-constituent filament according to the invention is either of the side-by-side type or of the core-sheath type which is off-centre over the whole length of the filament.

Of course, the two constituents can contain a small amount of modifiers, such as titanium oxide for reducing the glossiness of the yarn, colorants or pigments, products for reducing static, and the like.

The relative proportions of the two constituents are generally 50/50 by weight, although other proportions can also be used without going outside the scope of the invention. Thus, proportions of 30 to 70% by weight of each of the constituents give excellent results.

For a given copolyamide, the elastic recovery generally becomes greater as the proportion of the copolyamide constituent in the two-constituent filament increases. Moreover, for a copolyamide of given composition and for a given proportion of the copolyamide constituent in the filament, the results for elastic recovery can vary substantially with the inherent viscosity of the copolyamide. For a copolyamide of given composition, it will therefore be of value to find the most suitable inherent viscosity zone by means of simple experiments. Thus, for example, a copolyamide containing 70% of caprolactam and 30% of the salt of the dimeric acid (Empol 1010) will generally lead to good results for an inherent viscosity of at least 0.95, over a very extended range of proportions of the two constituents, whereas it will lead to unsatisfactory results for a lower viscosity and for certain proportions of the constituents.

Furthermore, the proportion of the copolyamide constituent in the filament can be lower, the greater is the proportion therein of salt of the long-chain reactant. Conversely, if the copolyamide used has a low proportion of salt of the long-chain reactant, the results will be better, provided its inherent viscosity is not too low, and as the proportion of this constituent in the yarn increases, although it is of no great advantage to exceed 50% by weight of copolyamide in the yarn.

The filaments according to the present invention are obtained by simultaneously extruding the two polymers, in the molten state, through a spinneret for spinning two-constituent filaments, using known means. After cooling, the filaments are sized and stretched, also using known means, in a ratio which is a function of the spinning conditions and depends on the residual elongation which is desired for the final yarn.

The filaments according to the invention can be used in all the usual applications of crimped yarns. They are particularly valuable in the knitted garments trade and especially in the manufacture of hosiery articles of good elasticity.

In the manufacture of hosiery articles from two-constituent yarns, known hitherto, which are made entirely of polyamides, the articles are generally subjected, after knitting, to a steam treatment at relatively high temperatures, for example of the order of 120° C., before they are dyed. This steam treatment is principally intended to develop the crimp of the yarn, which produces the elasticity of the article, and also to obtain the required dimensional stability.

Now, contrary to all expectations, it has been found that a steam treatment, before dyeing, of the articles knitted from the filaments according to the present invention is generally unnecessary since the development of the crimp is achieved at a sufficiently low temperature to enable it to be carried out during dyeing, which is generally effected using plastosoluble dyes at about 90°–95° C. The dimensional stability of the article obtained under these conditions is satisfactory. The use of the filaments according to the invention therefore represents a significant economic advantage.

It has therefore been found that the good properties of the filament according to the invention are due to the juxtaposition, in the latter, of a polyhexamethyleneadipamide with a copolyamide produced from caprolactam and from at least one saturated long-chain reactant possessing at least 22 carbon atoms, in the form of a salt.

It is of particular importance that all the reactants used in the manufacture of the polyamide and of the copolyamide should be completely or virtually completely saturated.

In fact, especially the copolyamide which is used must be substantially linear and of adequate molecular weight.

The reactants must therefore be only difunctional, that is to say essentially a diacid, diamine, aminoacid or lactam, and, furthermore, they must not possess ethylenic double bonds capable of forming bridges between chains under the action of temperature.

The use in the manufacture of the copolyamide, of long-chain reactants satisfying these two requirements does not introduce any restriction on the processing temperatures, which can reach almost 300° C., or on the proportions which can be very high because the salt of the long-chain reactant can be used, with good results on the yarn obtained, at the rate of 60% by weight, relative to all the reactants producing the copolyamide, which corresponds to about 50% of long-chain reactant in the copolyamide. This is of value because it has been found that the properties of elastic recovery which are obtained in particular with the yarn according to the present invention are the better, the richer in long-chain reactant is the copolyamide used.

Finally, the yarn according to the invention does not show any tendency to undergo thermo-oxidative or photo-oxidative degradation.

When it has not been subjected to any developing treatment, the yarn obtained according to the present invention has a flat or very slightly wavy appearance, which makes it possible to knit very easily under very good conditions, and in particular at high speed. This yarn is therefore very well suited to the industrial field for the manufacture of hosiery articles and also to the processes for knitting other articles, and the dyeing operation under the usual conditions, for example at about 90°–95° C. using plastosoluble dyes, provides an adequate heat treatment for obtaining a good development of the crimp and leads to articles of high elastic performance, particularly as regards the elastic recovery.

The elastic recovery is measured on legs of panty hoses which have been manufactured on a circular loom having a diameter of 4 inches and possessing 400 needles. The legs are suspended by means of clips at the level of the briefs part and the length $L_1$ is measured under a load of 3 kg. This load is maintained for 3 minutes, after which it is removed and replaced by a load of 20 g, and the length $L_2$ is measured under the latter load.

The elastic recovery is given by the formula $$\frac{L_1 - L_2}{L_1} \times 100$$

This measurement of $L_2$ is repeated every minute for 10 minutes, which leads to an elastic recovery curve such as those of FIG. 1.

In this figure, two series of curves A and B have been brought together side by side, using the same scale.

The curves of series A were plotted for knitted fabrics which were dyed at 90°–95° C., using plastosoluble dyes, directly after knitting, without any intermediate treatment.

The curves of series B were plotted for knitted fabrics which were dyed after a steam treatment in the free form at 120° C.

Figure 1:
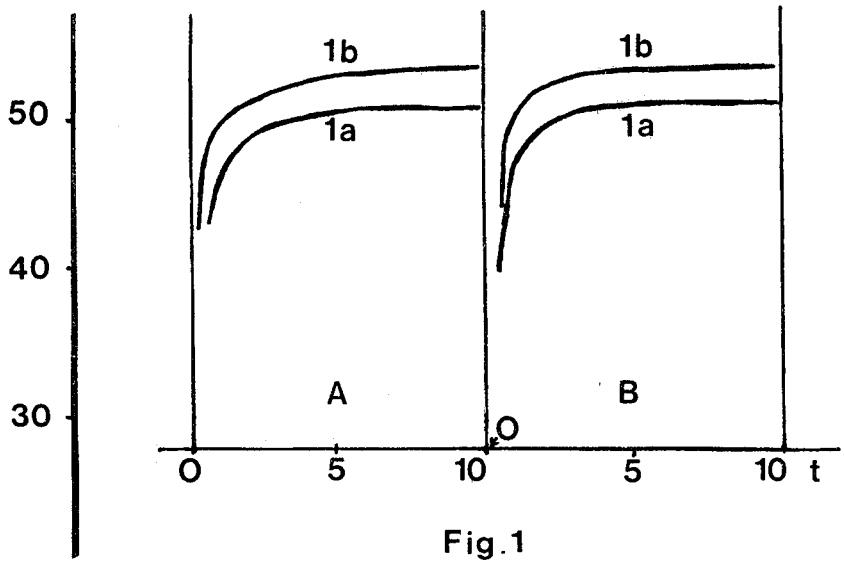

In general terms, if it is desired to use a yarn for manufacturing hosiery articles, it is considered that an elastic recovery of at least 50% is necessary for obtaining hosiery articles of good wearability and that elastic recoveries of 55–60% are of particular value.

Obviously, knitted fabrics having an elastic recovery of less than 50% and even less than 40% can be used for purposes other than a hosiery article, especially the purposes for which the pulling forces are smaller.

The following examples are given in order to illustrate the invention without in any way limiting it.

EXAMPLE 1

A. A polyhexamethyleneadipamide having a relative viscosity of 39.5 (measured on a solution of 8.4% strength by weight in 90% strength formic acid at 25° C.) and containing 0.3% of titanium dioxide is spun side by side with a copolyamide having an inherent viscosity of 0.930 (measured on a solution in distilled meta-cresol, which contains 0.5 g of polymer in 100 ml of solution) and produced from 70% by weight of caprolactam and 30% by weight of the hexamethylenediamine salt of a dimeric fatty acid which possesses 36 carbon atoms, contains less than 1% of the corresponding trimeric triacid, is virtually free from monoacid and almost completely saturated, has an iodine number of 7 and is distributed by Unilever-Emery N.V. under the trademark Empol 1010.

The hexamethylenediamine salt of the dimeric fatty acid is prepared as a 35% strength solution in a 50/50 by weight mixture of water and caprolactam, the equivalence point being monitored precisely using a pH meter. The solution obtained is introduced into an autoclave and the amount of caprolactam required to obtain a proportion of 70/30 by weight of caprolactam/salt is added, the mixture is stirred whilst sweeping with nitrogen and the temperature is raised to 270° C. and maintained for 3 hours. This yields the copolyamide of inherent viscosity 0.930.

After drying, the two polymers are melted separately at temperatures of 290° C. in the case of the polyhexamethyleneadipamide and of 270° C. in the case of the copolyamide. They pass into a transfer tube at 280° C. and are extruded in the proportion of 50% of each polymer, side by side, through a spinneret at 282° C. which possesses circular orifices of 0.4 mm diameter. The filaments are cooled with a stream of cold air by the usual processes and sized using a mixture of kerosene and an emulsion of ethylhexyl stearate and tridecylphosphoric acid with products resulting from the condensation of ethylene oxide with fatty acids and fatty alcohols.

A yarn of 3 filaments is produced which passes over a system of feed rollers at ambient temperature at a speed of 575 meters/minute and then over a system of unheated stretching rollers at a speed of 2,150 meters/-minute, which stretches the yarn in a ratio of 3.74 X. Finally, it is wound up at 2,113 meters/minute. The yarn obtained (yarn 1*a*) possesses a gauge of 22 dtex.

Part of this yarn 1*a* is subjected to a developing treatment by heat, using hot air at 120° C. in a nozzle. The yarn is delivered at a speed of 530 meters/minute and wound up, after passing through the nozzle, at a speed of 400 meters/minute (yarn 1*b*).

These yarns are knitted as indicated above for the measurement of the elastic recovery, and the knitted fabrics obtained are dyed without a steam treatment or after a steam treatment at 120° C. The dyeing is carried out at about 90° C. in a bath containing, relative to the material to be dyed:

0.6% of Disperse Yellow No. 3
0.18% of Disperse Red No. 1
0.16% of Blue 14, and
1 g/liter of a wetting product, with a liquor ratio of 1/50.

The elastic recovery of the various knitted fabrics obtained is examined and the corresponding curves are shown in FIG. 1:

in zone A for the knitted fabrics dyed without a steam treatment,
in zone B for the knitted fabrics dyed after a steam treatment at 120° C.

These curves show that the yarn 1*a*, which produces an elastic recovery of 51% on a knitted fabric dyed without a steam treatment, leads to similar values on a knitted fabric which has been subjected to a steam treatment at 120° C. and then dyed under the same conditions.

The yarn 1*b* produces elastic recovery values of essentially the same order as those obtained with the yarn 1*a*, whether or not the knitted fabric has been subjected to a steam treatment at 120° C. before dyeing.

It is therefore possible to deduce that the introduction of additional treatments, such as a differential development by heat of the yarn and/or the steam treatment of the undyed knitted fabric, does not bring any substantial improvements to the elastic recovery of the knitted fabrics obtained.

By way of comparison, a yarn obtained from the same polyhexamethyleneadipamide as above and from a copolyamide produced from 75% by weight of hexamethylenediamine adipate, 10.5% of hexamethylenediamine terephthalate and 19.5% of 3-aminomethyl-3,5,5-trimethyl-1-aminocyclohexane, and prepared in the same manner, gives a knitted fabric having an elastic recovery which is equal to at most 25%, by direct dyeing of the knitted fabric, and can increase to at most 35–40% on a knitted fabric dyed after a steam treatment at 120° C.

EXAMPLES 2 to 5

A polyhexamethyleneadipamide of relative viscosity 39 and a copolymer produced from caprolactam and from the hexamethylenediamine salt of the same dimeric fatty acid as in Example 1 are spun under the same conditions as in Example 1a, in a proportion of 50/50.

For the various examples, the copolymer possesses the following characteristics:

| Example | 2 | 3 | 4 | 5 |
|---|---|---|---|---|
| % of caprolactam by weight | 90 | 80 | 70 | 50 |

-continued

| Example | 2 | 3 | 4 | 5 |
|---|---|---|---|---|
| % of salt by weight | 10 | 20 | 30 | 50 |
| inherent viscosity | 1.209 | 1.212 | 1.164 | 1.042 |
| melting point °C. | 212 | 206 | 200 | 176 |

The polymers are melted at:

300° C. for the polyhexamethyleneadipamide,
270° C. for the copolymers of Examples 2, 3 and 4, and
260° C. for the copolymer of Example 5. All the other spinning conditions are identical to those of Example 1.

The yarns 2, 3, 4 and 5 are obtained.

All these yarns were knitted as in Example 1 and the knitted fabrics were dyed, without a prior steam treatment, also as in Example 1.

Figure 2:
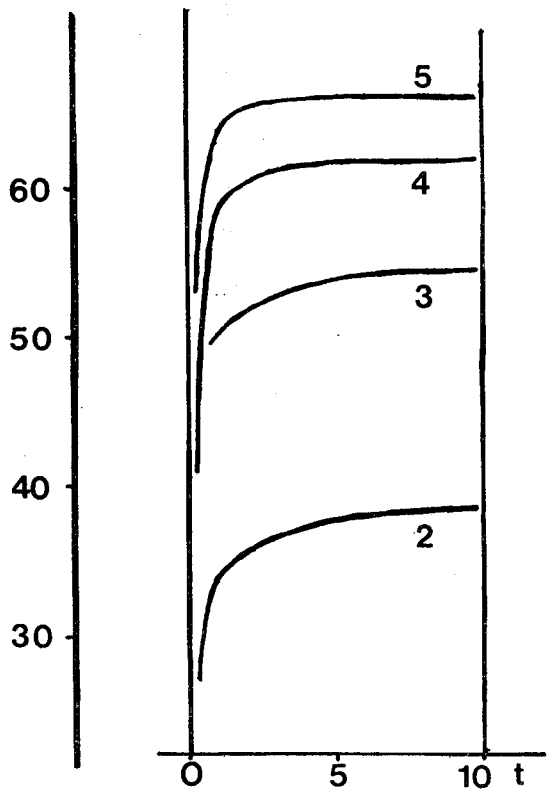
FIG. 2 shows the elastic recovery curves of Examples 2 to 5.

The measurements of elastic recovery produced curves shown in FIG. 2.

These curves show that the yarns 3, 4 and, in particular, 5 are particularly good for an article of hosiery because they produce elastic recoveries which are distinctly greater than 50% and even reach 66% in the case of the yarn 5. The yarn 2, which produces an elastic recovery of 38%, is used especially for any articles which are subjected to lower pulling forces than a hosiery article, such as underwear or pullovers.

EXAMPLES 6 to 8

The same pair of polymers as in Example 4 is used in the same proportion.

After drying, the polymers are melted, by means of a plasticising screw machine, at:

300° C. for the polyhexamethyleneadipamide, and
260° C. for the copolyamide.

They pass into a transfer tube at 280° C. and are extruded, side by side, through a die at 275° C. under the following conditions:

| Example | 6 | 7 | 8 |
|---|---|---|---|
| number of orifices in the spinneret | 3 | 5 | 7 |
| diameter of the orifices in mm | 0.4 | 0.23 | 0.23 |

In all cases, the flow rates of polymer are regulated so that each of these three yarns possesses an overall gauge of 22 dtex after stretching.

After extrusion, cooling with a stream of cold air and sizing as in Example 1, the yarns pass over a system of feed rollers at ambient temperature at a speed of 650 meters/minute and then over a system of unheated stretching rollers at a speed of 2,500 meters/minute, which gives a stretching ratio of 3.84 X, and are finally wound up at 2,460 meters/minute. The yarns 6*a*, 7*a* and 8*a* are obtained.

Part of each of these yarns is subjected to a developing treatment by heat using air at 100° C. in a nozzle. The yarns are delivered at a speed of 480 meters/minute and are wound up, after passing through the nozzle, at a speed of 400 meters/minute. The yarns 6*b*, 7*b* and 8*b* are obtained.

Figure 3:
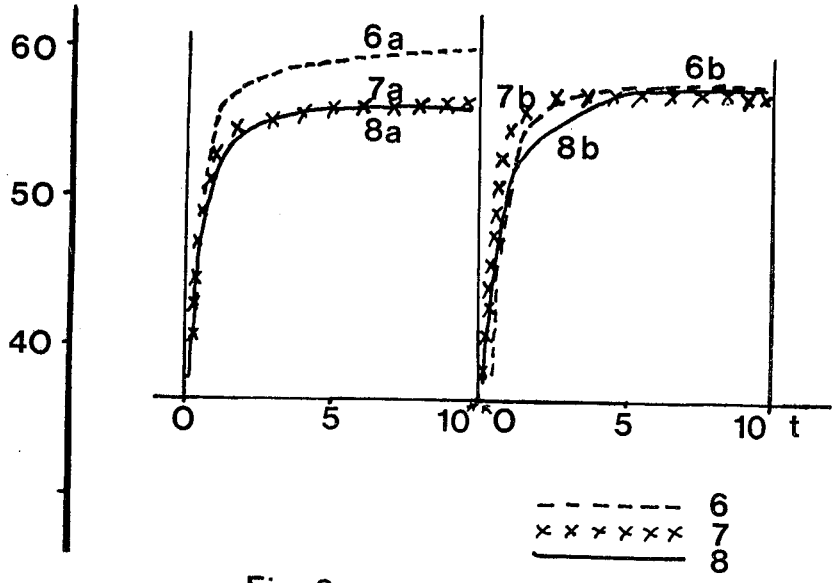
FIG. 3 shows the elastic curves of Examples 6 to 8 and FIG. 4 shows those of Example 9, for a knitted fabric which was dyed without a steam treatment, in A, and for a knitted fabric which was dyed after a steam treatment at 110° C., in B.

After knitting and dyeing the 6 yarns obtained, the elastic recovery of the knitted fabrics is measured and the curves obtained are shown in FIG. 3.

It can be seen that the elastic recovery of the yarn 6*a* reaches 60%, whereas the recovery curves of Examples 7a and 8a overlap and reach 56%. The elastic recovery of the three yarns which have been subjected to a developing treatment is of the order of 58% for all three (6b, 7b and 8b). It is therefore seen that, in the case of a yarn having the same overall gauge, the elastic recovery is of the same order regardless of the number of individual filaments and hence the fineness of each of them, whether or not they have been subjected to a developing treatment.

EXAMPLE 9

The same pair of polymers as in Example 4 is spun under the same conditions. Immediately after the stretching rollers, the yarn obtained passes into a nozzle, through which steam passes and the body of which is at 140° C. This yarn is wound up at 1,740 meters/minute, which corresponds to a 19% relaxation in steam.

The yarn obtained is knitted as in Example 1.

Figure 4:
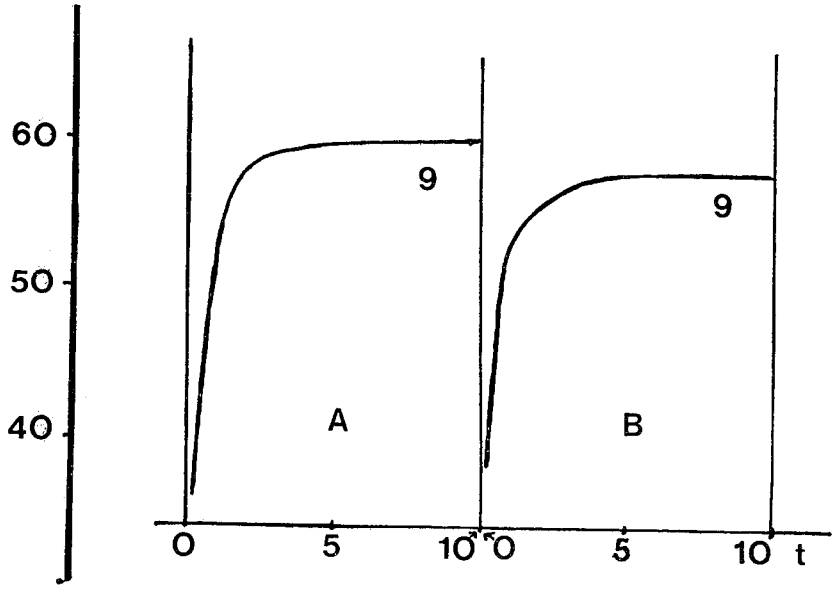

Part of the articles obtained is dyed as in Example 1, without a prior steam treatment. The knitted fabrics obtained are examined and the elastic recovery curve obtained is shown in zone A of FIG. 4.

Another part of the undyed knitted fabric is dyed in the same manner, but after a steam treatment at 110° C. The elastic recovery curve is given in zone B of FIG. 4.

As shown by these curves, the elastic recovery is of the same order, namely 60% for the directly dyed knitted fabric and 58% for the knitted fabric dyed after a steam treatment.

It is known that a polyamide yarn can only produce packages of good quality (dimensional stability and case of unwinding) in an integrated spinning/stretching process if it has been relaxed between the stretching roller and the winding spindle.

As can be seen in Example 9, the relaxation operation, which is required in order to ensure the dimensional stability and the ease with which the packages can be unwound, is carried out on the filaments according to the invention without affecting the elastic properties of the knitted articles.

EXAMPLES 10 to 17

A polyhexamethyleneadipamide of relative viscosity 39 and a copolymer produced from 70% by weight of caprolactam and 30% by weight of the hexamethylenediamine salt of the same dimeric fatty acid as in Example 1 are spun under the same conditions as in Example 1a, but in varying proportions.

Depending on the inherent viscosity of the copolyamide and the proportions of the two constituents in the yarn, the following results are obtained for knitted fabrics dyed as in Example 1, without a prior steam treatment.

| Example | Viscosity of copolyamide | Proportion of copolyamide in % | Elastic recovery in % after 10 minutes |
|---|---|---|---|
| 10 | 0.91 | 33.3 | 35 |
| 11 | 0.95 | 50 | 56.4 |

-continued

| Example | Viscosity of copolyamide | Proportion of copolyamide in % | Elastic recovery in % after 10 minutes |
|---|---|---|---|
| 12 | 1.10 | 33.3 | 52 |
| 13 | 1.10 | 50 | 62 |
| 14 | 1.10 | 66.7 | 63 |
| 15 | 1.21 | 33.3 | 50 |
| 16 | 1.21 | 50 | 60 |
| 17 | 1.21 | 66.7 | 60 |

Example 10 shows that the use of a small proportion (33.3%) of a copolyamide containing 30% of the salt of the dimeric acid and having an inherent viscosity of only 0.91 produces an inadequate elastic recovery, whereas the same copolyamide of similar viscosity (0.93), but in a proportion of 50% in the yarn, gives good results, namely 51% in the case of Example 1a.

The various parameters, namely the composition of the copolyamide, the inherent viscosity of the copolyamide and the proportion of copolyamide in the yarn, should therefore be chosen judiciously in order to obtain good results; this can easily be achieved by those skilled in the art, depending on the desired result.

What is claimed is:

1. Textile filament having two continuous constituents over the whole length of the filament, said textile filament being capable of being made up into knitted fabrics of high elastic recovery without requiring a steam treatment, characterized in that one of the constituents is polyhexamethyleneadipamide and the other constituent is a copolyamide produced from caprolactam and at least one long-chain amide-forming difunctional reactant which is essentially saturated and pure and which possesses a divalent aliphatic or cycloaliphatic hydrocarbon radical containing at least 20 carbon atoms, and optionally possessing at least one hydrocarbon substituent, the said long-chain difunctional reactant being either a diacid or a diamine in the form of their salts formed with one another or with another saturated diamine or diacid.

2. Filament according to 1, in which the caprolactam from which the copolyamide is produced represents 40 to 80% by weight of all the reactants employed in the production of the said copolyamide.

3. Filament according to 2, in which the caprolactam represents 50 to 70% by weight of all the reactants employed in the production of the copolyamide.

4. Filament according to 1, in which the long-chain reactant is produced by the dimerisation of unsaturated aliphatic acids possessing at least 11 carbon atoms, followed by hydrogenation and purification.

5. Filament according to 4, in which the long-chain reactant is produced by the dimerisation of olefinic acids containing 18 carbon atoms and by the hydrogenation and purification of the resulting dimer.

6. Filament according to 1, in which the polyhexamethyleneadipamide and the copolyamide are each present in an amount of 30 to 70% by weight.

7. Filament according to 1, characterised in that it produces an elastic recovery of at least 50% in a knitted fabric obtained only by direct knitting and dyeing the knitted fabric at a temperature of the order of 90°–95° C., any other heat treatment being excluded.

* * * * *